United States Patent [19]

Wright et al.

[11] Patent Number: 5,026,130

[45] Date of Patent: Jun. 25, 1991

[54] GEAR/RACK FLIPPER DOOR MECHANISM

[75] Inventors: Alan R. Wright, Wyoming; Edward D. Soberalski, Belmont, both of Mich.

[73] Assignee: Haworth, Inc., Holland, Mich.

[21] Appl. No.: 620,452

[22] Filed: Nov. 30, 1990

Related U.S. Application Data

[63] Continuation of Ser. No. 446,922, Dec. 6, 1989, abandoned.

[51] Int. Cl.[5] ..... A47B 88/00

[52] U.S. Cl. ..... 312/323

[58] Field of Search ..... 312/323

[56] References Cited

U.S. PATENT DOCUMENTS

| | | | |
|---|---|---|---|
| Re. 28,994 | 10/1976 | Aylworth . | |
| 641,459 | 1/1900 | Macey | 312/110 |
| 657,017 | 8/1900 | Tobey . | |
| 726,957 | 5/1903 | Macey . | |
| 1,288,665 | 12/1918 | Page | 312/110 |
| 3,339,995 | 9/1967 | Bencene . | |
| 3,748,005 | 7/1973 | Chovanec et al. . | |
| 3,771,847 | 11/1973 | Aylworth | 312/321.5 |
| 3,794,401 | 2/1974 | Dean et al. | 312/323 |
| 4,265,502 | 5/1981 | Blodee et al. . | |
| 4,375,907 | 3/1983 | Vander Kooi et al. | 312/323 X |
| 4,516,813 | 5/1985 | Sekerich | 312/323 |
| 4,591,214 | 5/1986 | Reuter et al. | 49/257 X |
| 4,600,254 | 7/1986 | Whalen . | |
| 4,615,570 | 10/1986 | Goodman | 312/317.1 |
| 4,641,896 | 2/1987 | Iimura et al. | 312/110 |
| 4,725,108 | 2/1988 | Wilson | 312/323 |

*Primary Examiner*—Joseph Falk

*Attorney, Agent, or Firm*—Flynn, Thiel, Boutell & Tanis

[57] ABSTRACT

A storage cabinet is provided with a front opening for access to the interior thereof, and a door is coupled to the cabinet for movement between a closed position wherein the door extends vertically across the access opening, and an open storage position wherein the door is disposed generally horizontally and is positioned at least in partial overlapping relationship directly over the cabinet top wall. A pair of support mechanisms couple the door to the cabinet housing adjacent the upper corners thereof. The support mechanism includes an intermediate support member which is hinged on a bracket secured adjacent the front edge of the housing top wall for swinging movement about a horizontal hinge axis which is located adjacent the front edge of the top wall. A gear is rotatably supported on the intermediate support member with its rotational axis being spaced radially from the hinge axis. The gear is maintained in continuous meshing engagement with an elongate gear rack which is fixed to the inner side of the door and extends generally perpendicularly between the upper and lower edges thereof. A guide track is also fixed to the inner surface of the door in generally parallel relationship to the gear rack. The intermediate support has a guide part which is slidably engaged with the guide track, and which couples the door to the intermediate support so as to permit solely relative sliding therebetween and hinging generally about the hinge axis.

9 Claims, 6 Drawing Sheets

GEAR/RACK FLIPPER DOOR MECHANISM

This application is a continuation of U.S. Ser. No. 446,922, filed Dec. 6, 1989, now abandoned.

FIELD OF THE INVENTION

This invention relates to a cabinet having an openable door and, in particular, to an improved support mechanism which enables the door to be hinged upwardly about a generally horizontal axis into an open position and then moved generally linearly into a storage position disposed substantially directly over the cabinet top wall.

BACKGROUND OF THE INVENTION

Storage cabinets are conventionally utilized in offices wherein a boxlike cabinet housing is provided with a front opening, and a door is positionable over the opening for closing of the cabinet. The door is conventionally mounted on the cabinet by a support which permits the door to be swung upwardly about its upper edge into an open position, and then moved generally linearly into a storage position wherein the door is disposed substantially directly over the top wall of the cabinet. Such cabinets are often referred to as employing a "flipper" door. In one conventional and frequently utilized construction, the door is coupled to the cabinet by a pair of hinge-type telescopic ball slide mechanisms which mount between the top wall and the door adjacent opposite edges thereof. Such cabinet is disclosed in U.S. Pat. No. 3 771 847. While cabinets of this type operationally perform in a desirable manner, nevertheless the hinge-type telescopic ball slide mechanisms are expensive, and hence make such cabinets more expensive than desired.

Other known cabinets have attempted to utilize a rack-and-pinion mechanism for coupling the door to the cabinet to permit both the desired hinging and translating movement. In these known arrangements, however, the rack is normally fixed to the cabinet, specifically to or adjacent the top wall, so as to extend transversely in the front-to-back direction. The pinions are generally carried on brackets which are mounted on the inner upper corners of the door. The pinions permit the door to pivot into an open position about the pinion axis, and then the pinions can roll along the rack toward the rearward end thereof so as to permit storage of the door. In many of the known cabinets, this arrangement has been designed such that the rack is stored inside the cabinet directly beneath the top wall. In other arrangements, the door has been stored directly over the top wall, but such arrangements have normally required the provision of elongate slots or clearance spaces extending transversely of the top wall so as to permit the pinions to project therethrough for engagement with the racks. This arrangement, one example of which is illustrated by U.S. Pat. No. 4,615,570, is undesirable in view of the necessity of having to provide such slots in the cabinet top wall.

Another problem encountered with prior cabinet designs, particularly those in which the door is intended to be swung upwardly and then moved rearwardly for storage over the top wall, is the difficulty in providing a cabinet wherein the upper edge of the door is generally flush with the upper surface of the top wall when the door is closed, while at the same time permitting movement of the door into a storage position above the top wall. In this arrangement, difficulties have been encountered in providing a hinging and translating mechanism for coupling the door to the cabinet which does not undesirably project upwardly above the upper edge of the door when the latter is in its closed position.

Accordingly, it is an object of the present invention to provide a cabinet of the above type, namely a cabinet having a door which hinges upwardly and then translates rearwardly for storage above the top wall, which cabinet incorporates therein an improved mechanism for permitting both hinging and linearly translating of the door between a closed position and an open storage position wherein the door is disposed above the cabinet top wall.

More specifically, this improved mechanism is believed to provide for efficient and dependable operation of the door without encountering racking of the door during the opening and closing operations, is mechanically reliable and dependable in operation, and can be economically manufactured and installed.

Further, the improved mechanism as incorporated into the cabinet of this invention permits operation in the above manner while permitting the upper edge of the door to be disposed substantially flush with the cabinet top wall when the door is closed, without the mechanism protruding upwardly above the door in an undesirable and unsightly manner.

Other objects and purposes of the invention will be apparent to persons familiar with structures of this general type upon reading the following specification and inspecting the accompanying drawings.

SUMMARY OF THE INVENTION

The present invention comprises a cabinet having a boxlike housing defined by generally parallel top and bottom walls rigidly joined by generally parallel side walls. The housing has the front side thereof open to permit access to the interior of the cabinet. A door is adapted to extend vertically across the front opening when in a closed position. A pair of support mechanisms coupled opposite upper corners of the door to the cabinet, specifically the top wall, so that the door can be swung about a horizontal hinge axis disposed adjacent the front edge of the top wall into an open position, with the door thereafter being linearly movable rearwardly for storage directly over the top wall. Each support mechanism includes an elongate toothed rack extending transversely across the inner surface of the door between the upper and lower edges thereof. A support bracket is hinged on the top wall and defines a horizontal hinge axis for the door. The support bracket mounts thereon a pinion which is maintained in meshing engagement with the rack. The pinion is rotatably supported on the bracket with its rotational axis disposed radially spaced relationship from the hinge axis of the bracket. The bracket also has guide structure which slidably cooperates with mating guide structure on the rack so that the bracket can be linearly slidably displaced along the rack while maintaining the rack and pinion in meshing engagement with one another. Opening of the door enables the bracket and the pinion eccentrically carried thereon to be swung upwardly about the hinge axis, whereby the pinion project upwardly through a slot formed in the top wall so as to maintain meshing engagement with the rack as the door is slidably moved rearwardly into a storage position over the top wall. When the door swings back to its closed position, the eccentric position of the pinon on the bracket causes the pinion to swing downwardly below the upper surface of the top wall.

Figure 1:
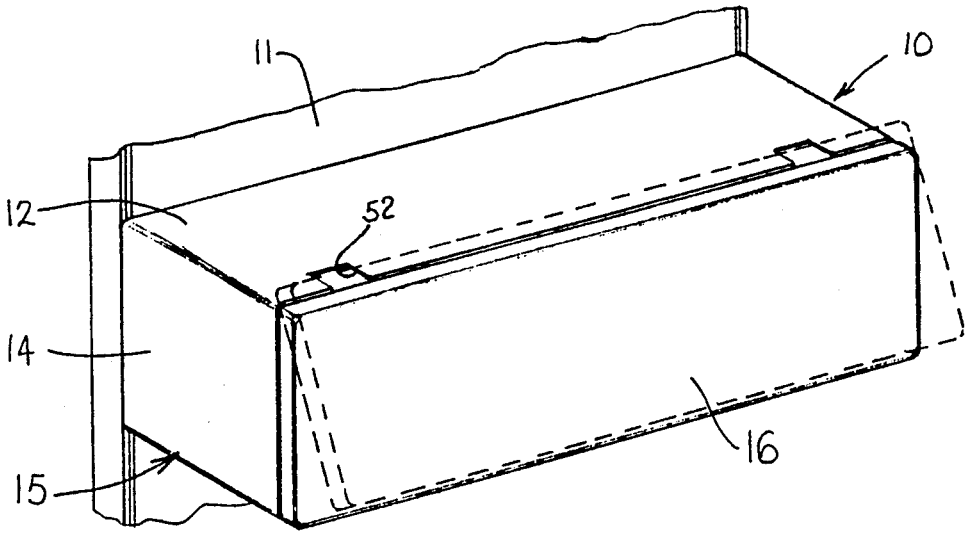
FIG. 1 is a perspective view of a flipper-door cabinet shown mounted in cantilevered fashion on a vertical wall panel.

Certain terminology will be used in the following description for convenience in reference only, and will not be limiting. For example, the words "upwardly", "downwardly", "rightwardly" and "leftwardly" will refer to directions in the drawings to which reference is made. The word "upwardly" will also be used in reference to the normal opening direction of the door. The word "front" will also be used with reference to the side of the cabinet on which the door is positioned, and the word "rear" will make reference to the other side, namely the side which attaches to the wall panel. The words "inwardly" and "outwardly" will refer to directions toward and away from, respectively, the geometric center of the cabinet structure and designated parts thereof. Said terminology will include the words specifically mentioned, derivatives thereof, and words of similar import.

DETAILED DESCRIPTION

FIG. 1 illustrates a flipper-door cabinet 10 mounted in a conventional cantilevered fashion on one side of a vertical wall panel 11. The cabinet 10 includes generally parallel top and bottom walls 12 and 13 respectively, which are rigidly joined together by opposed and generally parallel end walls 14 so as to define an interior storage compartment or space. These walls cooperate to define a boxlike cabinet housing 15, the front side of which defines an opening for permitting access to the interior of the cabinet. A door 16 is positionable to overlap and hence close off the front opening of the cabinet, substantially as illustrated by FIG. 1. The door 16, when in the closed position, is oriented in a generally vertical plane and is disposed so as to substantially directly overlie the front edges of the walls defining the cabinet housing. The walls of the cabinet in the illustrated embodiment are constructed from thin metal plate, but it will be appreciated that the walls can be constructed of other suitable materials such as particle board. The door can be similarly constructed.

Figure 2:
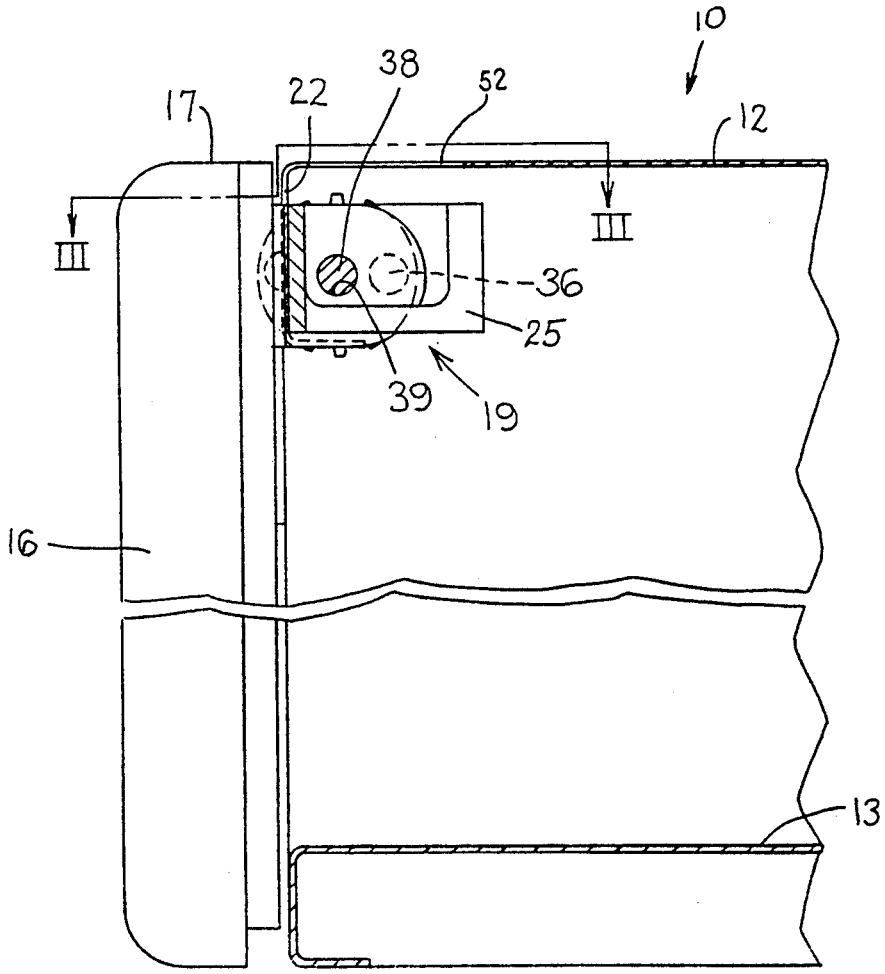
FIG. 2 is a fragmentary elevational view, in cross section, showing the front of the cabinet and the door in a closed position.

In the present invention, and as illustrated by FIG. 2, the door 16 is disposed, when in the closed position, with its upper edge 17 located at an elevation which is disposed approximately within the horizontal plane defined by the upper surface of the top wall 12.

Figure 4:
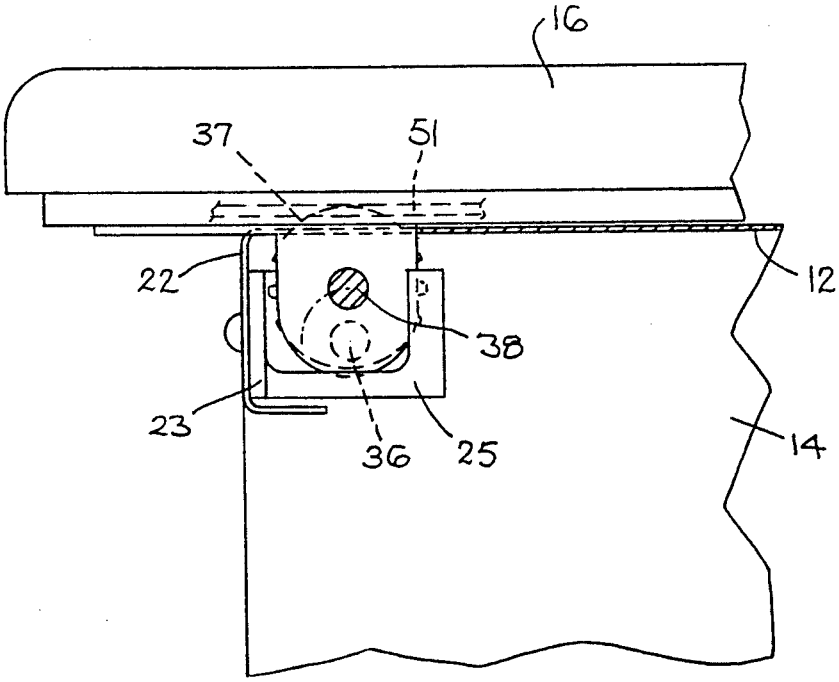
FIG. 4 is a fragmentary sectional view similar to FIG. 2 but showing the door in its open stored position as disposed above the cabinet top wall.
Figure 5:
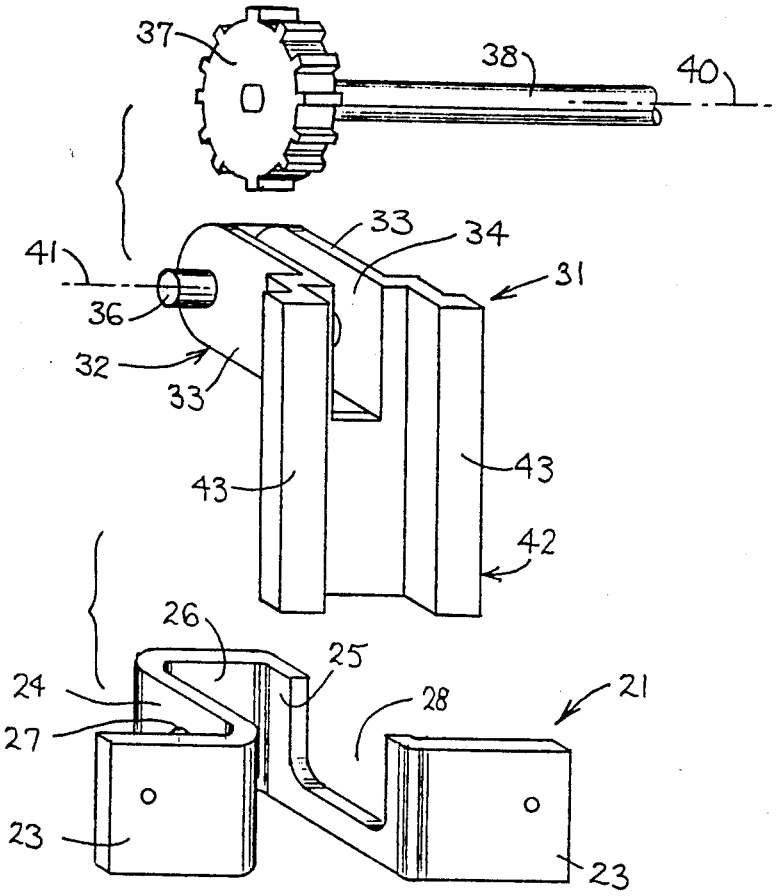
FIGS. 5 and 6 are exploded perspective views of the components which make up the support mechanisms for the door.
Figure 6:
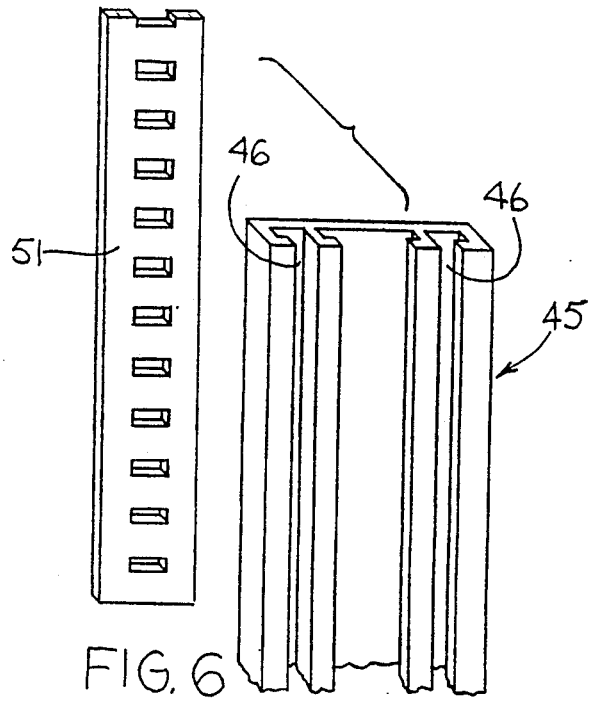

To permit movement of the door 16 between closed and open positions substantially as illustrated by FIGS. 2 and 4, respectively, the cabinet 10 includes a pair of support mechanisms 19 which are connected to the cabinet housing adjacent the front upper corners thereof, and which also connect to the inner surface of the door in the vicinity of the opposite end edges thereof. These support mechanisms 19 are normally identical, or mirror images of one another, so that only one such mechanism will be described below.

Before describing the structure of the support mechanism 19 in detail, it should be noted that this support mechanism 19 includes a hinge structure which permits the door to be pivotally swung about a generally horizontal axis from the closed position wherein the door is suspended generally vertically across the open front of the cabinet, into a open position wherein the door is oriented generally horizontally and projects outwardly away from and approximately aligned with the top wall of the cabinet. The support mechanism 19 also includes a linear translating structure which enables the door to be linearly moved inwardly from the last-mentioned open position into a storage position wherein the door is at least partially disposed directly over the cabinet top wall 12, substantially as illustrated by FIG. 4.

Referencing FIGS. 2–6, the support mechanism 19 includes a support bracket 21 which is fixedly secured to the cabinet housing directly adjacent the front edge of the top wall 12 thereof. This bracket 21 is positioned directly under the top wall 12 and is fixedly secured directly rearwardly of a small front flange 22 which projects downwardly from the front edge of the top wall 12 so as to define the upper edge of the door opening. Bracket 21 has a pair of support plates or feet 23 which overlie the inner surface of the flange 22 and are fixed thereto by any suitable means such as screws or rivets. The bracket 21 includes a pair of sidewardly spaced and generally parallel support flanges 24 and 25 which project rearwardly away from the front cabinet flange 22 while being position directly under the top wall 12. These flanges 24 and 25 are sidewardly spaced apart and are generally vertically oriented so as to define a downwardly-opening clearance space therebetween. The rearward end of these flanges 24 and 25 are, in the preferred embodiment, rigidly joined by a transverse flange 26 which provides additional strength and manufacturing convenience. The outer side flange 24 has a cylindrical opening 27 extending therethrough, and the inner flange 25 has an enlarged slot or recess 28 formed therein.

The support bracket 21 in turn hingedly supports thereon an intermediate support member 31. This latter member 31 includes a leverlike part 32 which is defined by a pair of generally parallel and sidewardly spaced side plates 33 which define an appropriate clearance space 34 therebetween. These side plates 33 are rigidly joined together and, at one end thereof, the one plate 33 has a cylindrical hinge pin 36 fixedly joined thereto and projecting sidewardly therefrom. This hinge pin 36 is sized so as to be snugly but rotatably supported within the opening 27 defined in the adjacent support flange 24.

A tooth-type driving wheel 37 (more specifically a pinion or gear) is positioned in the space 34 between the side plates 33, which gear 37 is nonrotatably secured to one end of an elongate shaft 38. This shaft 38 projects through and is rotatably supported within an opening 39 defined in the other side plate 33 so that the longitudinal and hence rotational axis 40 of this shaft 38 and gear 37 is parallel to but spaced radially from the axis 41 defined by the hinge pin 36. When the door is in the closed position, the rotational axis 40 is spaced forwardly a selected distance from the hinge axis 41. The shaft 38 extends through the clearance slot 28 defined in the adjacent side flange 25, and extends horizontally transversely across the cabinet in the vicinity of the front edge of the top wall thereof so as to rigidly join together the two gears 37 as associated with the support mechanisms disposed adjacent the opposite ends of the cabinet.

The intermediate support member 31 also includes a guide structure 42 which is fixedly, here integrally, joined to the lever part 32 adjacent the outer end thereof. This guide part 42 is elongate in a direction which extends generally perpendicular to a radial line which passes perpendicularly between the axes 40 and 41, with this elongate guide part 42 being generally vertically oriented when the door is in a closed position. The guide part 42 defines thereon a pair of generally parallel and sidewardly-spaced elongate guides or rails 43 which extend in the generally elongate direction of the part 42.

Figure 3:
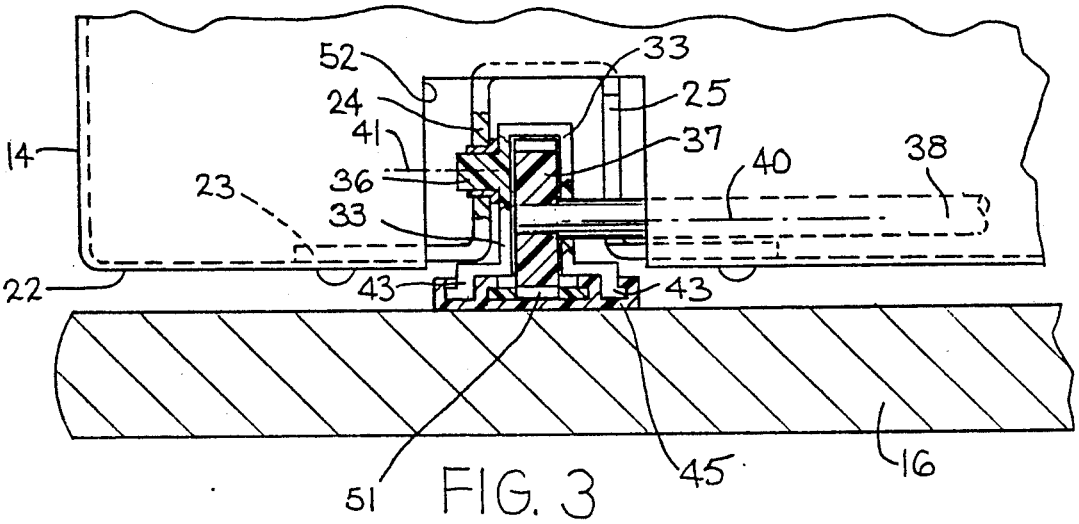
FIG. 3 is a fragmentary sectional view taken substantially along line III—III in FIG. 2.

The latter-mentioned guide part 42 is adapted for slidable engagement with an elongate guide track 45 which is fixed to the inner surface of the door 16. This guide track 45 extends generally perpendicularly of the door between the upper and lower edges thereof in close proximity to one end edge of the door. The guide track 45 extends transversely across a majority of the door height and includes a pair of generally parallel and sidewardly spaced guide slots 46 which extend generally throughout the length of the guide track. These guide slots are generally undercut and open sidewardly in opposite directions, substantially as illustrated by FIG. 3, and hence slidably accommodate and confine therein the guide rails 43 provided on the guide part 42. In this manner, the guide part 42 and guide track 45 are hence coupled together so as to permit solely relative sliding movement therebetween, which sliding movement of the guide track 45 relative to the guide part 42 occurs generally within a vertical plane which is perpendicular to the rotational axis 41. A suitable stop is provided at the upper end of the guide slots 46 so as to abut against the upper ends of the guide rails 43 when the door is in its closed position.

An elongate tooth element 51, specifically a gear rack, is fixed to and extends generally longitudinally along the guide track 45. This gear rack 51 faces inwardly toward the interior of the cabinet when the door is closed, and extends longitudinally along the guide track 45 in generally parallel relationship with and generally between the guide slots 46. This gear rack 51 is disposed in continuous meshing engagement with the drive gear 37 as supported on the intermediate support member 31.

To facilitate the upward swinging of the door into the open position, the top wall 12 of the cabinet is provided with cutouts or openings 52 therein which project rearwardly a limited extent from the front edge of the top wall and are disposed directly over the respective support brackets, as illustrated by FIG. 3.

OPERATION

The operation of the door and of its support mechanism will now be briefly explained in relationship to FIGS. 2–6.

When the door is in the closed position wherein it is disposed in a vertical orientation directly adjacent the front of the cabinet, as illustrated by FIG. 2, the guide part 42 of the intermediate support member 31 is disposed within the upper ends of the guide slots 46 and abuts the stops so as to hold the door in a proper closed position relative to the cabinet housing. In this closed position, the support mechanisms 19 are disposed such that the gear rotational axis 40 is spaced forwardly from the pivot axis 41, although these axes are generally somewhat positioned in approximately the same horizontal plane. Further, the gear 37 is disposed in meshing engagement with the gear rack 51 adjacent the end thereof located in close proximity to the upper edge of the door.

When the door is to be opened, it is manually gripped adjacent the lower edge thereof and is pivotally swung outwardly and upwardly in the manner illustrated by dotted lines in FIG. 1. This pivoting of the door occurs generally about the axis 41 and, due to the manner in which the intermediate support 31 is coupled to the guide track 45, this support 31 also pivots along with the door generally about the axis 41, whereby the gear axis 40 also swings in a planetary manner about the axis 41. Thus, the door can be swung into a fully opened and generally horizontal position without causing any relative movement between the meshed gear and rack. Further, during this movement into the open position, the gear 37, due to its planetary-type swinging movement about the pivot axis 41, effectively moves upwardly and projects through the cutout 52 in the top wall 12 so as to project slightly above the top wall.

After reaching the fully open position, the door 16 can then be linearly displaced rearwardly into a storage position wherein it is disposed directly above the top wall 12, substantially as illustrated by FIG. 4. As the door is being moved rearwardly so as to overlap the top wall, the gears 37 rotatably meshingly engage the respective gear racks 51, and simultaneously the guide parts 42 slide along the guide tracks 45. Since the gears 37 adjacent the opposite upper corners of the cabinet are nonrotatably coupled together by the intermediate shaft 38, the gears hence rotate synchronously and prevent any sideward racking of the door relative to the cabinet.

When the door is to be closed, the closing operation is merely a reversal of the opening operation as described above.

While the above operation has described the opening (or closing) operation as being a sequential two-step one, namely a swinging movement followed by a linear movement, it will be appreciated that these movements can overlap and be at least partially accomplished simultaneously since once the opening swinging movement of the door has been initiated, it is possible to start moving the door rearwardly over the top wall prior to the door reaching its fully open horizontal position.

With this arrangement as described above, the complete support mechanism is compactly disposed in the upper front corners of the cabinet entirely below the top wall when the door is closed, as illustrated by FIG. 2, whereby the door can hence have its upper edge disposed substantially flush with the top wall, and at the same time the support mechanism is not visible from the front of the cabinet. Further, since the gear racks are fixed to and carried on the door, the cabinet need not be provided with elongate clearance slots through the top wall thereof in order to permit storage of the door above the top wall, but rather only the small cutouts are necessary in the top wall so as to accommodate the upward swinging of the gears during the opening movement of the door.

MODIFICATIONS

Figure 7:
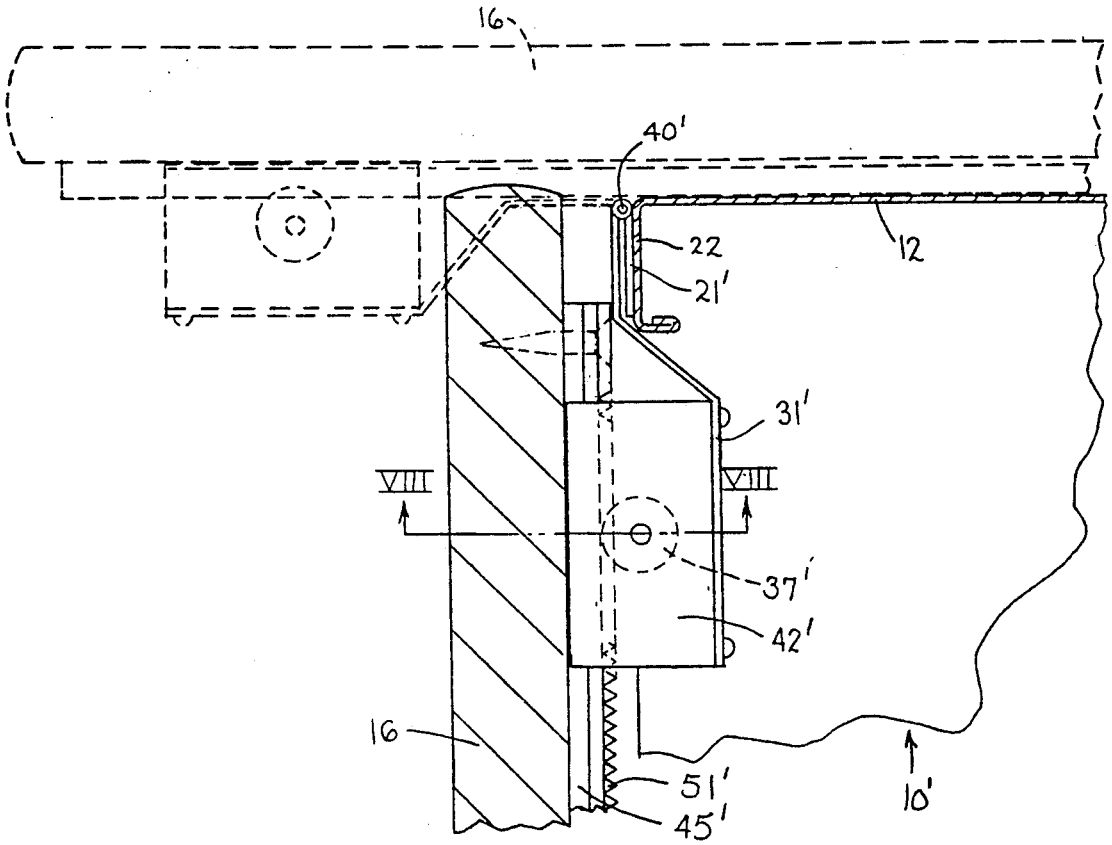
FIG. 7 is a view similar to FIG. 2 but illustrating a variation of the support mechanism.
Figure 8:
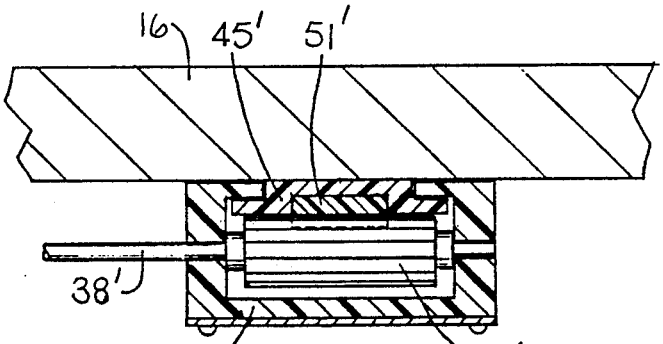
FIG. 8 is a fragmentary sectional view taken substantially along line VIII—VIII in FIG. 7.

FIGS. 7 and 8 illustrate a variation of the present invention which operates in a generally similar manner. In this variation, the support bracket 21' is formed essentially as a flat plate which is fixedly secured directly to the outer side of the top front flange 22, and the intermediate support member 31' is coupled to the support bracket by a conventional horizontally elongate hinge pin which defines the hinge axis 40', this hinge axis being disposed exteriorly of and directly adjacent the upper horizontal edge of the front flange, the hinge axis hence being directly adjacent the front edge of the top wall. The intermediate support member 31' mounts thereon a blocklike part which functions as the guide part 42' and is slidably guided on the elongate guide track 45' which is secured to the inner surface of the door. This guide track in turn mounts thereon the elongate gear rack 51'. The gear rack is maintained in continuous meshing engagement with a gear or toothed wheel 37' which is rotatably carried on the support member 31'.

With this arrangement illustrated by FIGS. 7 and 8, a pair of identical support mechanisms are again provided adjacent the upper corners of the cabinet and permit the door to be swung upwardly into an open position and moved linearly rearwardly into a storage position generally over the top wall. This arrangement does not require that any slots or cutouts be made in the top wall, but does result in some components of the support mechanisms being disposed forwardly of the cabinet when the door is in an open position.

Figure 9:
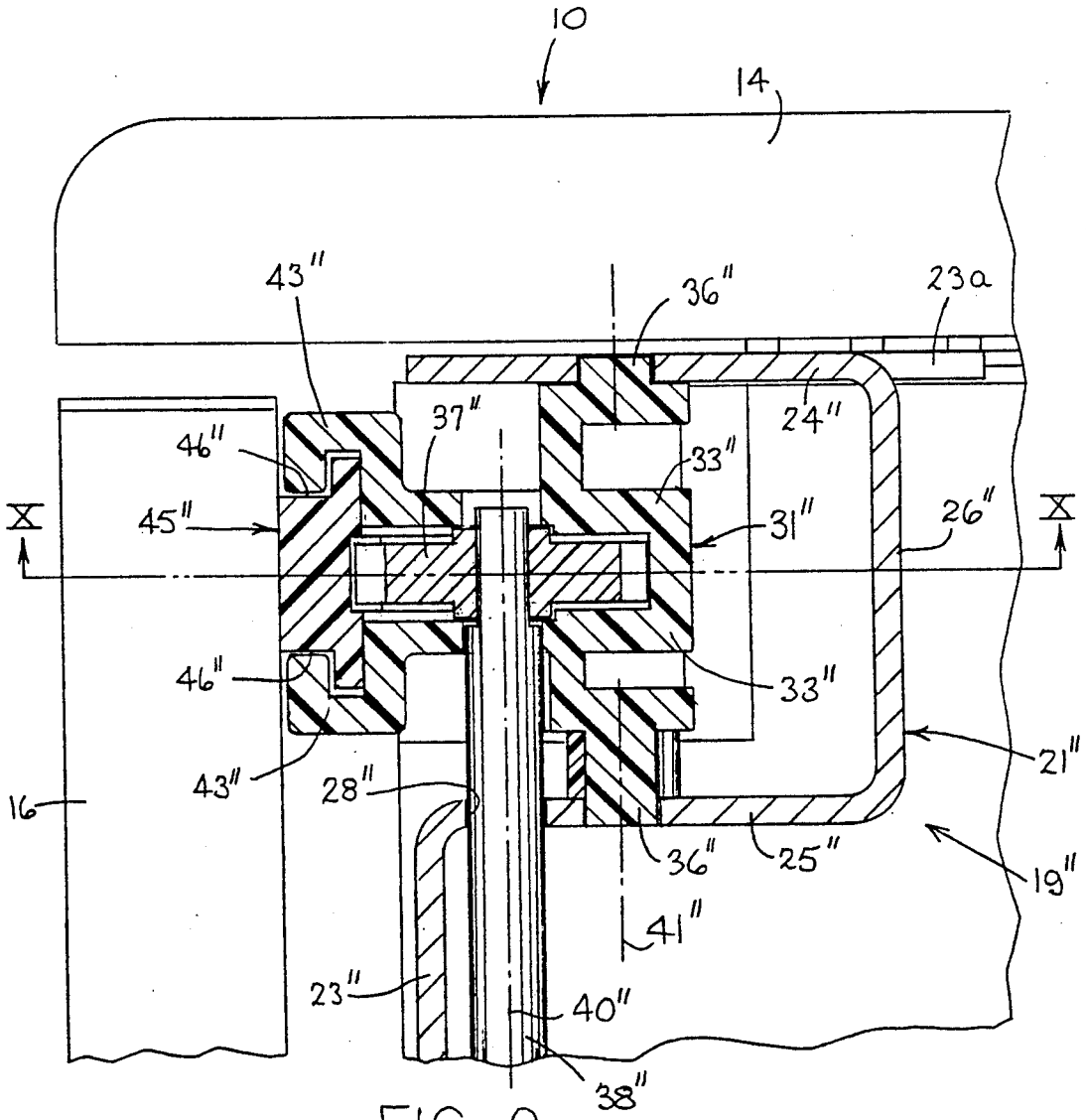
FIG. 9 is a fragmentary sectional view taken substantially along line IX—IX in FIG. 10 and illustrating a preferred variation of the support mechanism.
Figure 10:
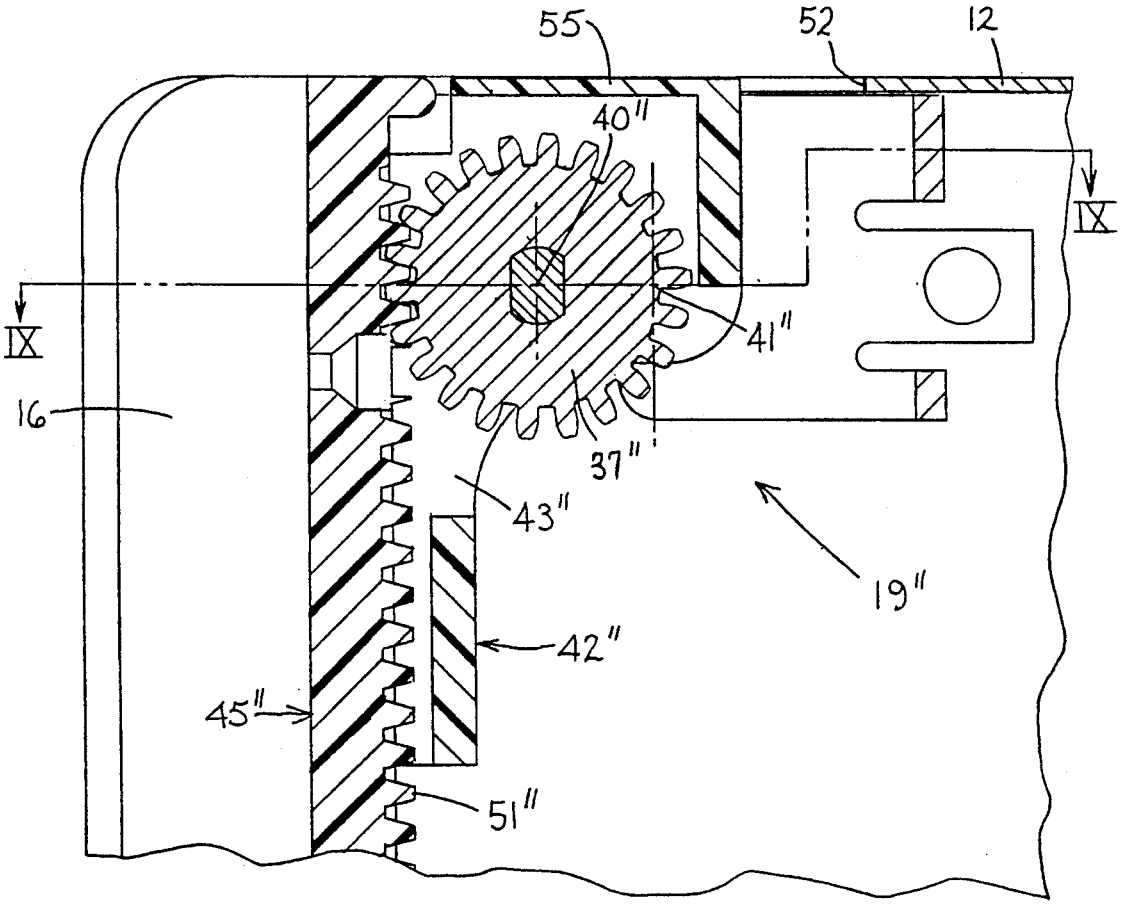
FIG. 10 is a fragmentary sectional view taken substantially along line X—X in FIG. 9.

Referring now to FIGS. 9 and 10, there is illustrated a preferred variation of the present invention which is in many way similar to the embodiment of FIGS. 1–6, and hence corresponding parts have been designated by use of the same reference numerals but with addition of a double prime (") thereto.

In the variation of FIGS. 9 and 10, the support bracket 21" is again fixedly secured to the cabinet housing directly adjacent the front edge of the top wall, and in fact one support foot 23" again overlies and is fixedly secured to a small front flange which extends along and depends downwardly from the top wall. In the illustrated embodiment, however, the support mechanism is disposed directly adjacent the end wall, rather than being slightly spaced inwardly therefrom (although the latter is also possible with this variation). Hence, the other support foot **23*a* of the bracket 21" projects inwardly from the bracket side wall 24" so as to directly overlie and be fixedly secured to the adjacent end wall 14 of the cabinet 10**.

The support bracket 21" again hingedly mounts thereon the intermediate support member 31" so that the latter is supported for swinging movement about the generally horizontally extending hinge axis 41". This intermediate support member 31" in turn rotatably supports the tooth-type driving wheel 37" thereon so that the latter is rotatable about an axis 40", the latter being defined by the rod 38" which extends between and joins to the gears 37" associated with the support mechanisms 19" located adjacent opposite end walls of the cabinet. The rod or shaft 38" extends through a slot 28" formed in side wall 25" of the bracket 21", this slot 28" being of an accurate configuration extending through an angle slightly in access of 90° as generated about the axis 41", with the ends of the slot being closed to confine the shaft 38" while permitting the gear 37" to swing through an angle of about 90° about the axis 41" as the door is movable between open and closed positions. The gear 37" is maintained in continuous meshing engagement with the elongate gear rack 51" which is fixed to and extends vertically downwardly along the inside surface of the door 16 when the latter is closed. Gear rack 51" is fixedly and here integrally joined to the guide track 45" which is fixed to the inner door surface and which, on opposite longitudinally-extending sides thereof, defines undercut guide slots 46" which open outwardly in opposite directions with respect to one another.

The intermediate support member 31" also has a guide part 42" which is fixedly and here integrally related thereto. This guide part 42" has a pair of sidewardly spaced and oppositely oriented guide rails or elements 43" which are generally L-shaped in cross section. These guide elements 43" are disposed so as to sidewardly straddle the guide track 45" and project into the undercut grooves 46" so as to prevent relative separation between the guide track 45" and the intermediate support member 31" while permitting relative slidable movement therebetween along the elongate direction of the guide track 45" and gear rack 51".

In this variation, the guide track 45" and gear 51" are all preferably integrally formed in one piece of a hard plastic material, and the intermediate support member 31" is also preferably formed as an integral one-piece plastic structure, thereby simplifying the overall construction of the support mechanism.

The intermediate support member 31", as illustrated in FIG. 10, also preferably has a top wall or cap 55 which is disposed over the gear 37" and extends between the side plates 33" for effectively closing off the gear 37" when the door is in the closed position illustrated by FIG. 10. When in this latter position, the top wall 55 is positioned substantially within the recess or cut out 52 as formed in the top wall 12 so as to be substantially flush with the top wall and hence partially close off the cut out 52.

The operation of the embodiment illustrated by FIGS. 9 and 10 corresponds substantially to the operation of the embodiment illustrated by FIGS. 1–6 so that further operational description thereof is believed unnecessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a storage cabinet having a housing defined by generally parallel top and bottom walls rigidly joined together by side walls, the housing defining therein an interior storage compartment and having an opening in a front side thereof for access to said storage compartment, a door positionable adjacent the front side of said housing when in a closed position for closing off said access opening, and a pair of support mechanisms disposed in sidewardly spaced relationship and connected between said door and said housing for permitting the door to be both swingably moved into an open position wherein the door extends generally horizontally in closed proximity to the elevation of the top wall and linearly into a storage position wherein the door is positioned at least partially closely adjacent and directly over said top wall, the improvement wherein said support mechanisms comprise:

a support bracket fixed to said housing in the vicinity of the front edge of said top wall;

a rigid leverlike support member pivotally mounted on said support bracket about a generally horizontal pivot axis which is fixedly disposed in close proximity to and extends approximately parallel with the front edge of said top wall, said support member being constrained solely for vertical swinging movement about said pivot axis;

elongate linear gear rack means fixed to said door and being accessible solely from the inner surface of the door, said gear rack means being elongate in a direction which extends generally perpendicularly between upper and lower edges of said door when the door is in said closed position;

elongate guide rail means fixed to said door in close proximity to said gear rack means and extending in generally parallel relationship with the elongate direction of said gear rack means;

gear wheel means rotatably supported on said support member for rotation about a generally horizontal rotational axis which is parallel to but spaced radially a predetermined distance from said pivot axis, said gear wheel means being supported on said support member for vertical swinging movement of said rotational axis about said pivot axis due to vertical swinging movement of said support member, said gear wheel means being continuously maintained in meshing engagement with said gear rack means;

said support member having guiding means fixedly mounted thereon and maintained in linear slidable engagement with said guide rail means for permitting solely linear slidably displacement along said rail means in the elongated direction thereof when said door is being moved between said closed and storage positions; and said support member and said guide rail means having cooperating structure which permits solely said relative slidable movement but which normally prevents separation of said door from said housing.

2. A cabinet according to claim 1, wherein said support mechanisms include a single elongate horizontal shaft which is positioned in close proximity to the front edge of said top wall and which extends generally therealong and has each end thereof nonrotatably coupled to one of said gear wheel means as associated with the respective support mechanism.

3. In a storage cabinet having a housing defined by generally parallel top and bottom walls rigidly joined together by side walls, the housing defining therein an interior storage compartment and having an opening in a front side thereof for access to said storage compartment, a door positionable adjacent the front side of said housing when in a closed position for closing off said access opening ,and a pair of support mechanisms disposed in sidewardly spaced relationship and connected between said door and said housing for permitting the door to be both swingably moved into an open position wherein the door extends generally horizontally in close proximity to the elevation of the top wall and linearly into a storage position wherein the door is positioned at least partially closely adjacent and directly over said top wall, the improvement wherein said support mechanisms comprise a support bracket fixed to said housing in the vicinity of the front edge of said top wall;

a support member pivotally mounted on said support bracket about a generally horizontal pivot axis which is disposed in close proximity to and extends approximately parallel with the front edge of said top wall;

elongate linear gear rack means fixed to said door and being accessible solely from the inner surface of the door, said gear rack means being elongate in a direction which extends generally perpendicularly between upper and lower edges of said door when the door is in said closed position;

elongated guide rail means fixed to said door in close proximity to said gear rack means and extending in generally parallel relationship with the elongate direction of said gear rack means;

gear wheel means rotatably supported on said support member for rotation about a generally horizontal rotational axis which is parallel to but spaced radially a predetermined distance from said pivot axis, said gear wheel means being maintained in meshing engagement with said gear rack means;

said support member having guiding means fixedly mounted thereon and maintained in linear slidable engagement with said guide rail means for slidably displacement therealong in the elongated direction thereof when said door is being moved between said closed and storage positions, said guiding means and said guide rail means having cooperating structure which permits solely said relative slidable movement but which prevents separation of said door from said housing; and said guide rail means including a pair of generally parallel and sidewardly spaced elongate guide grooves which extend along said elongate direction and are accessible from the inner side of said door, said guide grooves being undercut in opposite sideward direction, said guiding means of said support member including a pair of generally parallel and sidewardly spaced guide elements which are of generally L-shaped configuration and oppositely sidewardly directed so as to be slidably but captively retained within the pair of guide grooves, said gear rack means being fixedly positioned generally between said guide grooves, and said gear wheel means being positioned sidewardly between said guide elements.

4. A cabinet according to claim 3, wherein said guide elements are elongate in a direction which is perpendicular to a plane containing both of said pivot and rotational axes.

5. A cabinet according to claim 4, wherein said support mechanisms include a single elongate horizontal shaft which is positioned in close proximity to the front edge of said top wall and which extends generally therealong and has each end thereof nonrotatably coupled to one of said gear wheel means as associated with the respective support mechanism.

6. A cabinet according to claim 3, wherein said pivot axis is spaced slightly downwardly from the underside of said top wall and is spaced slightly rearwardly from the front edge of said top wall, and wherein said rotational axis is positioned generally horizontally forwardly from said pivot axis and in approximately the same horizontal plane when the door is in said closed position.

7. A cabinet according to claim 6, wherein said top wall has a small cutout formed therethrough directly adjacent the front edge thereof and directly over said gear wheel means so as to permit said gear wheel means to project upwardly through said cutout when the door is in said storage position.

8. A cabinet according to claim 7, wherein said gear wheel means has a radius which is greater than the radial spacing between said pivot and rotational axes.

9. A cabinet according to claim 7, wherein said door a horizontally-extending upper edge which is disposed substantially flush with the upper surface of said top wall when the door is in said closed position.

* * * * *

UNITED STATES PATENT AND TRADEMARK OFFICE

CERTIFICATE OF CORRECTION

PATENT NO. : 5 026 130

DATED : June 25, 1991

INVENTOR(S) : Alan R. Wright et al

It is certified that error appears in the above-identified patent and that said Letters Patent is hereby corrected as shown below:

Column 2, line 41; change "coupled" to ---couple---.

Column 2, line 54; after "disposed" insert ---in---.

Column 9, line 46; change "slidably" to ---slidable---.

Column 10, line 35; change "slidably" to ---slidable---.

Column 12, line 7; after "door" insert ---has---.

Signed and Sealed this

Twelfth Day of January, 1993

*Attest:*

DOUGLAS B. COMER

*Attesting Officer*

*Acting Commissioner of Patents and Trademarks*